United States Patent [19]

Fukuta et al.

[11] 4,113,002

[45] Sep. 12, 1978

[54] CHILL PREVENTING ARRANGEMENT FOR USE IN CENTRIFUGAL CASTING AND METHOD FOR PREVENTING CHILL THEREBY

[75] Inventors: Shigemi Fukuta; Hiroshi Izaki, both of Osaka; Shoichi Yoshino, Tondabayashi, all of Japan

[73] Assignee: Kubota, Ltd., Osaka, Japan

[21] Appl. No.: 712,068

[22] Filed: Aug. 5, 1976

[30] Foreign Application Priority Data

Dec. 11, 1975 [JP] Japan ..... 50-148902

[51] Int. Cl.[2] ..... B22D 13/02; B22D 13/10

[52] U.S. Cl. ..... 164/286; 164/19; 164/33; 164/138; 29/527.2

[58] Field of Search ..... 164/286, 298, 119; 249/114, 116, 204; 427/135; 29/527.2

[56] References Cited

U.S. PATENT DOCUMENTS

| | | | |
|---|---|---|---|
| 1,480,000 | 1/1924 | McWane | 164/298 |
| 2,903,375 | 9/1959 | Peras | 427/135 |

*Primary Examiner*—J. Howard Flint, Jr.

*Attorney, Agent, or Firm*—Wenderoth, Lind & Ponack

[57] ABSTRACT

A chill preventing arrangement is used in a metal mold employed in centrifugal casting. The metal mold is provided, at its spigot portion, with an end plate which has a central opening smaller in diameter than the internal diameter of the metal mold main body and which includes a metallic base plate, an intermediate layer of metallic alloy formed by flame or plasma spraying on a surface of the metallic base plate contacting the molten metal for casting, and a coating of ceramic material more than 0.7 mm thick formed on the intermediate layer by flame or plasma spraying for preventing chill formation at the corresponding end portions of tubular castings.

10 Claims, 4 Drawing Figures

CHILL PREVENTING ARRANGEMENT FOR USE IN CENTRIFUGAL CASTING AND METHOD FOR PREVENTING CHILL THEREBY

BACKGROUND OF THE INVENTION

The present invention relates to centrifugal casting and more particularly, to a chill preventing arrangement for use in centrifugal casting and method for preventing chill thereby.

Generally, in the centrifugal casting of metal, especially that of metal tubing or pipes and the like, there is employed a metal mold D or die as shown in FIG. 1 which normally includes a hollow cylindrical main body 1, an end plate E fitted into one end 1*a* or spigot portion of the main body 1 and having a central opening E*a* substantially smaller in diameter than the internal diameter of the main body 1, and another end plate C releasably fitted into the other end 1*b* of the main body 1 and having a central opening C*a* also smaller in diameter than the internal diameter of the main body 1 for preventing molten metal from running out of the ends 1*a* and 1*b* during casting. The molten metal *m* is poured into the mold main body 1 rotated by suitable means (not shown) at high speeds, via a spout S which enters the main body 1 through the central opening C*a* in the end plate C, and the metal in distributed evenly over the entire inner surface of the main body 1 to form a hollow cylindrical or tubular casting as indicated at mc through centrifugal force. In the process of the centrifugal casting as described above, it is known to apply a coating composition including a parting agent onto the inner surface 1*c* or molding surface of the mold main body 1 prior to pouring the molten metal *m* into the mold 1, so as to form a refractory coating or lining (not shown) on such molding surface 1*c* for protecting the mold D from fusing by the heat of the molten metal *m*, and also for preventing the metal *m* from excessively rapid cooling which will give rise to formation of undesirable chills in the resultant castings. Such coating composition is normally sprayed, through a nozzle (not shown) mounted at one end of a supply pipe or applicator lance (not shown), onto the molding surface 1*c* of the rotating mold D in a direction perpendicular to or somewhat inclined to the molding surface 1*c* as the applicator lance advances horizontally into the hollow interior of the mold main body 1.

In the conventional arrangement as described above, known as the one coating-one casting method wherein the coating is renewed at each casting, however, it is difficult to sufficiently apply the coating composition onto the inner surface E*b* of the end plate E whose surface is directed at right angles to the molding surface 1*c* whether the coating composition is sprayed onto the molding surface 1*c* in a direction perpendicular or rather inclined thereto, since the spraying is mainly directed toward the molding surface 1*c*, thus resulting in the formation of chills particularly at the corresponding end or spigot portion of the resultant casting which contacts the inner surface E*b* of the end plate E due to rapid cooling imparted by plate E. Although the drawbacks as described above may be overcome by applying the coating composition separately onto the inner surface E*b* of the end plate E at each casting, such a procedure is actually impractical, not only complicating the working process, but also resulting in reduction of productivity to a large extent. Accordingly, it is naturally required that the coating for the inner surface E*b* of the end plate E, if to be formed, should be of a durable nature.

In order to meet the above requirements, there have conventionally been proposed various countermeasures wherein refractory material mainly of molten silica embedded in grooves formed in the inner surface E*b* of the end plate E is calcined or wherein durable coating of known caking agents, for example, of phosphate, soluble glass and the like is applied onto the inner surface E*b* or in which refractory ceramic material is applied through flame spraying onto the surface E*b* to a thickness of 0.45 to 0.7 mm. Each of such countermeasures, however, has its weak point either in durability of the coating or in chill prevention effect, thus there being none which fully meets the desired requirements.

SUMMARY OF THE INVENTION

Accordingly, an essential object of the present invention is to provide a chill preventing arrangement for use in centrifugal casting and a method for preventing chill formation thereby which is capable of positively imparting a chill preventing effect of sufficient durability to an end plate of a metal mold.

Another important object of the present invention is to provide a chill preventing arrangement of the above described type and a method for preventing chill formation thereby in which a coating of ceramic material is applied onto an inner surface or molten metal contacting surface of an end plate for the prevention of chill formation at corresponding end portions of resultant castings.

A further object of the present invention is to provide a chill preventing arrangement of the above described type and a method for preventing chill formation thereby in which ceramic material is embedded in an annular groove formed at an inner surface or molten metal contacting surface of an end plate for the prevention of chill formation at corresponding end portions of resultant castings.

According to a preferred embodiment of the present invention, the end plate to be fitted into a spigot portion of a metal mold for use in centrifugal casting of tubular castings includes a circular metallic base plate having a central opening substantially smaller in diameter than the internal diameter of a main body of the metal mold, an intermediate layer of metallic alloy such as nickel-chromium alloy or molybdenum formed by flame or plasma spraying on a surface of the metallic base plate which contacts molten metal for casting in the metal mold, and a coating of ceramic material such as alumina, zirconia and the like more than 0.7 mm thick formed on the intermediate layer by flame or plasma spraying, by which arrangement, tubular castings free from chilling especially at the corresponding end portions or spigot portions thereof are advantageously obtained through provision of the ceramic coating having high durability and heat insulating properties, with substantial elimination of the disadvantages inherent in the conventional arrangements for preventing chill formation.

BRIEF DESCRIPTION OF THE DRAWINGS

These and other objects and features of the present invention will become apparent from the following description taken in conjunction with a preferred embodiment thereof with reference to the attached drawings in which.

Figure 1:
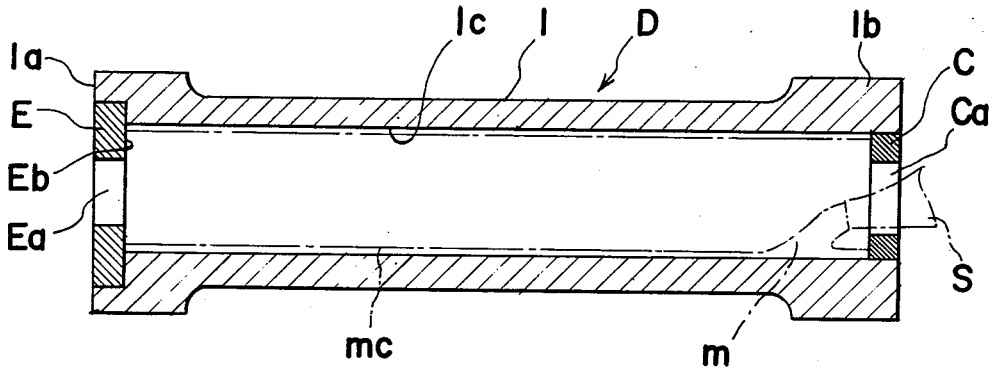
FIG. 1 Prior Art
FIG. 1 is a schematic side sectional view of a metal mold for use in centrifugal casting fitted with a conventional end plate which has already been discussed.

ing effect. In addition, if the known coating composition described with reference to FIG. 1 is applied, through the one-coating method, onto the ceramic coating 10*c*, further improvement in the durability and chill prevention effect can be achieved. Tabulated hereinbelow are comparative test results of actual castings wherein the end plates applied with the conventional durable coating and the end plate coated with the ceramic material according to the present invention are employed.

EXPERIMENT I

| Coating | Number of Castings attainable per one coating | Chill prevention effect |
|---|---|---|
| Conventional phosphate series coating | 5 to 10 times | Almost no effect |
| Conventional soluble glass series coating | 1 to 5 times | Almost no effect |
| Ceramic coating of the invention | More than 50 times | Chilling is not noticeable. Particularly superior in chill prevention effect when applied simultaneously with the conventional coating composition. |

DETAILED DESCRIPTION OF THE INVENTION

Before the description of the present invention proceeds, it is to be noted that like parts are designated by like reference numerals throughout the several views of the attached drawings.

Figure 2:
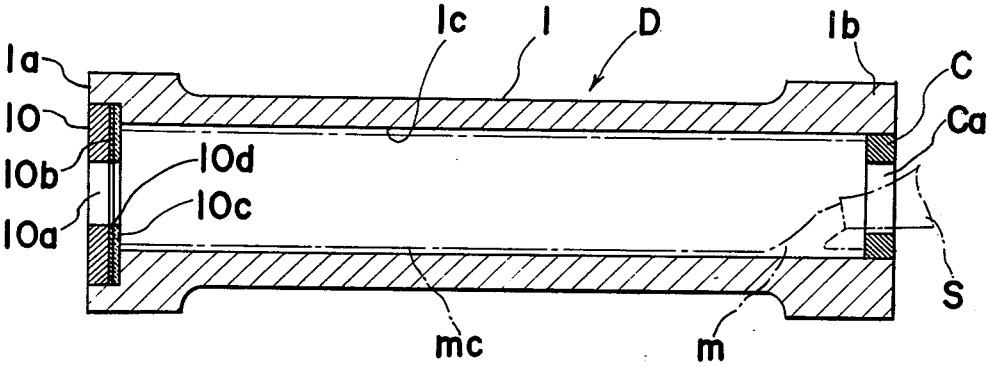
FIG. 2 is a view similar to FIG. 1, but with the metal mold fitted with an end plate according to one embodiment of the present invention.

Referring now to FIG. 2, there is shown an end plate 10 of the invention which is fitted into the one end 1*a* of the main body 1 of the metal mold D. The end plate 10 of circular disc-like shape has a central opening 10*a* smaller in diameter than the internal diameter of the main body 1 as described with reference to FIG. 1. It should be noted here that the present invention is directly related to the application of ceramic coating 10*c* onto the inner surface or molten metal contacting surface 10*b* of the end plate 10 which contacts the molten metal *m* so as to utilize the heat insulating properties and durability of the ceramic coating 10*c* for preventing chill formation in the corresponding end portion of the resultant tubular casting *mc*. The heat insulating properties of the ceramic coating 10*c* are particularly effective for reducing heat emission from the molten metal *m* and the corresponding end portion of the resultant tubular casting *mc* to prevent chilling at such end portions. For the application of the ceramic coating 10*c* onto the surface 10*b* of the end plate 10, it is necessary to prevent deterioration of peel resistance of the ceramic coating 10*c*, due to the difference in the thermal expansion coefficients of the metallic base material of the end plate 10 and the ceramic coating 10*c*. According to the present invention, the inner surface 10*b* of the end plate 10 is preliminarily made rough, for example, by shot blasting, with the subsequent application of a nickel-alumina or nickel-chromium powdered alloy (For example at the ratio of 80 to 20 by weight percentage) onto the surface 10*b* by flame or plasma spraying to form an intermediate layer 10*d* thereon, onto which layer 10*d*, the ceramic material is applied through flame spraying to form the ceramic coating 10*c* of more than 0.7 mm in thickness. The ceramic coating 10*c* thus formed on the end plate 10 through the intermediate layer 10*d* is superior in peel resistance, with excellent durability and chill preventing effect. In addition, if the known coating composition described with reference to FIG. 1 is applied, through the one-coating method, onto the ceramic coating 10*c*, further improvement in the durability and chill prevention effect can be achieved. Tabulated hereinbelow are comparative test results of actual castings wherein the end plates applied with the conventional durable coating and the end plate coated with the ceramic material according to the present invention are employed.

As is clear from the foregoing description, by the employment of the end plate coated with the ceramic material according to the present invention, hollow cylindrical or tubular castings free from chilling especially at the end portions thereof are readily obtained by centrifugal casting, thus contributing to improvements in the quality of such cylindrical castings to a large extent. Furthermore, the ceramic coating according to the invention having by far the higher durability than the conventional durable coatings is quite advantageous from the viewpoint of productivity.

It should be noted here that the present invention is particularly characterized in that the excellent chill preventing effect with high durability is obtained by the combination of the intermediate layer of metallic alloy formed on the molten metal contacting surface of the end plate and the coating of ceramic material more than 0.7 mm thick further formed on the intermediate layer.

It should also be noted that although the present invention is mainly described with reference to the centifugal casting employing the so called one coating-one casting method, the concept of the present invention is readily applicable to other centrifugal casting methods, and that the ceramic coating described as effected to the inner surface of the end plate in the above embodiment may further be applied onto the molding surface of the main body of the metal mold for increasing the chill preventing effect thereof, depending on necessity.

Figure 3:
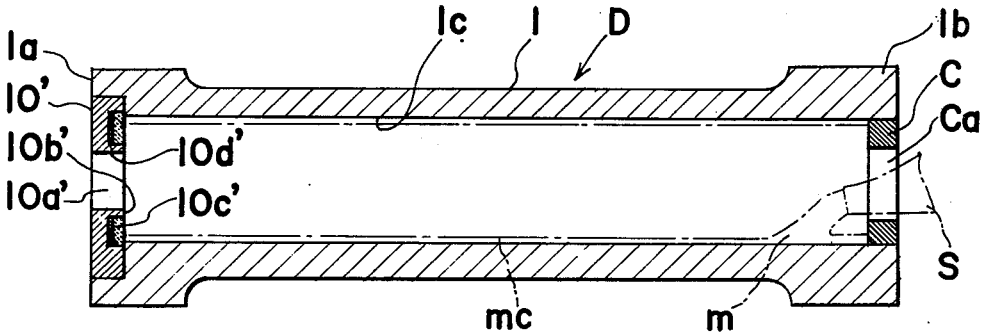
FIG. 3 is a similar view to FIG. 2, but with the metal mold fitted with a modified end plate according to the present invention.
Figure 4:
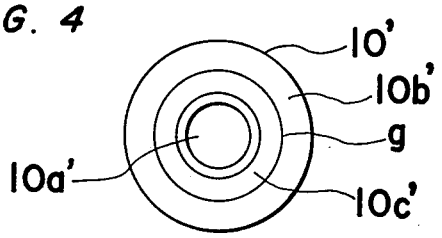
FIG. 4 is a top plan view of the modified end plate employed in the metal mold of FIG. 3, with the metal mold removed for clarity.

Referring now to FIGS. 3 and 4, there is shown a modification of the embodiment of FIG. 2. In this modification, the ceramic coating 10*c* described as applied onto the entire surface 10*b* of the end plate 10 is replaced by a ceramic layer 10*c'* of alumina, zirconia or the like embedded, through flame or plasma spray coating, into a groove *g* concentrically formed in the molten metal contacting surface 10*b'* of the end plate 10', with the surface of the ceramic layer 10*c'* being flush with and exposed from the surface 10*b'* of the end plate 10'. For the formation of the ceramic layer 10*c'*, the groove *g* approximately 10 mm wide and more than 0.7 mm deep is formed concentrically in the surface 10*b'* of the end plate 10' by machining means such as a lathe or the like. Prior to embedding of the ceramic material into the groove *g*, for example, by the flame spray coating, the entire inner surface of groove *g* is roughened, for example, by shot blasting, and thereafter, powdered nickel-chromium alloy or molybdenum and the like is flame-sprayed into the groove *g* to form an intermediate layer 10*d*' in the groove *g* for preventing peeling of the ceramic material due to the difference in the thermal expansion coefficients of the metallic base material of the end plate 10' and the ceramic material. Subsequently, the ceramic material such as alumina, zirconia or the like is flame-sprayed onto the intermediate layer 10*d*' to form the ceramic layer 10*c*' more than 0.7 mm in thickness thereon so that the surface of the ceramic layer 10*c*' exposed from the molten metal contacting surface 10*b*' is flush with surface 10*b*'. In this case, if the surface of the ceramic layer 10*c*' is required to be particularly smooth, it is preferable to finish the same surface for smoothness with a diamond grinding wheel or the like. It should be noted here that in the present invention, the thickness of the ceramic layer 10*c*' is determined to be more than 0.7 mm, since any thicknesses less than 0.7 mm are hardly effective for chill prevention. Tabulated hereinbelow are comparative test results for chill prevention effect and durability in actual castings wherein the conventional end plates and the end plate of FIGS. 3 and 4 are employed.

EXPERIMENT II

| Kinds of end plates | Chill prevention effect (depth of chilling measured on the actual castings) | Durability in repeated use |
|---|---|---|
| Conventional end plate | 3 to 5 mm | 300 times |
| Conventional end plate wherein refractory material mainly of soluble silica is embedded | 0 mm | 147 times |
| Conventional end plate wherein ceramic material is flame-sprayed on its molten metal contacting surface to thickness of 0.4 to 0.7 mm | 1 to 2 mm | 1,500 times |
| End plate in FIGS. 3 and 4 of the invention | 0 mm | 1,000 to 2,000 times |

As is seen from the foregoing description, the modified end plate 10' of FIGS. 3 and 4 shows best result in the chill preventing effect and durability of the end plate itself. Furthermore, in the modified end plate 10' of the invention, since the ceramic material such as alumina, zirconia or the like is embedded in the groove formed in the molten metal contacting surface of the end plate through the flame spray means, unlike the conventional refractory materials which inevitably require calcination, the superior refractory and heat insulating properties of the embedded ceramic material advantageously prevent the chill formation in the resultant castings. In addition, the rigid adhesion of the ceramic layer into the groove in comparison with the formation of the ceramic coating on the flat surface of the end plate makes it possible to increase the ceramic layer to sufficient thickness without danger of peeling, thus resulting in improved durability, with the chill prevention effect lasts for a longer period of time. Moreover, according to the end plate of the invention, not only castings of stable quality without chilling are readily obtained, but the durability of the metal mold itself is largely improved.

It should be noted that the present invention is particularly characterized in that the excellent chill preventing effect with high durability is obtained by the formation of the intermediate layer of metallic alloy in the groove formed in the molten metal contacting surface of the end plate and the formation of the coating of ceramic material more than 0.7 mm thick on the intermediate layer.

It should also be noted here that although the present invention is mainly described with reference to the end plates 10 and 10' to be fitted into the spigot portion 1*a* of the metal mold D, similar arrangements may of course be made to the end cap C to be fitted into the other end 1*b* of the metal mold D, depending on necessity, in which case, however, if a known core member (not shown), for example, of resin-sand (silica sand fixed by phenolic resin and the like) is disposed in the end portion 1*b* of the metal mold D in a position adjacent to and in contact with the end plate C with the opening C*a* of the end plate C acting as a vent hole, formation of such ceramic coating on the inner surface of the end plate C is not particularly necessary.

It is needless to say that the concept of the present invention is not limited in its application of the metal mold for the centrifugal casting referred to in the foregoing description, but is readily applicable to any other casting molds wherein the prevention of chilling is required.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

We claim:

1. A method for preventing chilling at an end portion of a uniform diameter tubular casting formed in a centrifugal casting mold including an end plate against a flat surface of which said end portion is formed, said method comprising:

forming a groove in said end plate surface and roughening the surface of said groove;

then forming an intermediate metal alloy layer in said groove by flame or plasma spraying a metal alloy material therein;

forming a ceramic coating of a thickness greater than 0.7 mm on said intermediate layer by flame or plasma spraying ceramic material thereon until said ceramic coating is exposed from said end plate surface; and machining the exposed surface of said ceramic coating until it is smooth and flush with the inner surface of said end plate surface.

2. A method for preventing chilling as claimed in claim 1, wherein said groove is an annular groove concentrically formed in said surface of said end plate.

3. A method for preventing chilling as claimed in claim 1, wherein said intermediate layer of metallic alloy is of nickel-chromium or molybdenum alloy.

4. A method for preventing chilling as claimed in claim 1, wherein said coating of ceramic material consists of alumina.

5. A method for preventing chilling as claimed in claim 1, wherein said coating of ceramic material consists of zirconia.

6. An arrangement for preventing chilling at an end portion of a uniform diameter tubular casting formed in a centrifugal casting mold of the type including an end plate against a flat surface of which said end portion is formed, said arrangement comprising:

said end plate including a metallic base plate having said flat surface therein;

a groove formed in said metallic base plate surface, said groove having a roughened surface;

an intermediate metal alloy layer formed by flame or plasma spraying in said groove; and a ceramic coating formed by flame or plasma spraying on said intermediate layer, said ceramic coating having a thickness greater than 0.7 mm, and said ceramic coating having an exposed surface which is smooth and flush with said metallic base plate surface by having been machined.

7. An arrangement for preventing chilling as claimed in claim 6, wherein said groove is an annular groove concentrically formed in said surface of said metallic base plate.

8. An arrangement for preventing chilling as claimed in claim 6, wherein said intermediate layer of metallic alloy is of nickel-chromium or molybdenum alloy.

9. An arrangement for preventing chilling as claimed in claim 6, wherein said coating of ceramic material consists of alumina.

10. An arrangement for preventing chilling as claimed in claim 6, wherein said coating of ceramic material consists of zirconia.

* * * * *